US006655700B1

(12) United States Patent
Caputo et al.

(10) Patent No.: US 6,655,700 B1
(45) Date of Patent: Dec. 2, 2003

(54) SHOCK-ABSORBING APPARATUS

(76) Inventors: Robert John Caputo, 1860 Traden Dr., San Jose, CA (US) 95132; Michael Timothy Higgins, 2356 E. Chennault Ave., Fresno, CA (US) 93720

( * ) Notice: Subject to any disclaimer, the term of this patent is extended or adjusted under 35 U.S.C. 154(b) by 0 days.

(21) Appl. No.: 09/918,758

(22) Filed: Jul. 30, 2001

Related U.S. Application Data

(63) Continuation-in-part of application No. 09/108,077, filed on Jun. 30, 1998, now Pat. No. 6,296,258.

(51) Int. Cl.[7] ..... B62B 13/00

(52) U.S. Cl. ..... 280/14.22; 280/11.3; 280/613

(58) Field of Search ..... 280/14.22, 613, 280/623, 624, 11.2, 11.3, 625, 633, 634, 638, 611

(56) References Cited

U.S. PATENT DOCUMENTS

| | | | | | |
|---|---|---|---|---|---|
| 2,597,800 | A | * | 5/1952 | Hussman | 248/565 |
| 4,741,550 | A | * | 5/1988 | Dennis | 280/618 |
| 5,188,386 | A | * | 2/1993 | Schweizer | 280/607 |
| 5,577,755 | A | * | 11/1996 | Metzger et al. | 280/607 |
| 5,586,779 | A | * | 12/1996 | Dawes et al. | 280/14.24 |
| 5,667,237 | A | * | 9/1997 | Lauer | 280/607 |
| 5,755,046 | A | * | 5/1998 | Dodge | 36/117.3 |
| 5,897,128 | A | * | 4/1999 | McKenzie et al. | 280/607 |
| 5,913,530 | A | * | 6/1999 | Berger et al. | 280/607 |
| 5,947,488 | A | * | 9/1999 | Gorza et al. | 280/14.21 |
| 6,022,041 | A | * | 2/2000 | Dailey et al. | 280/618 |
| 6,062,584 | A | * | 5/2000 | Sabol | 280/607 |
| 6,062,586 | A | * | 5/2000 | Korman | 280/613 |
| 6,206,402 | B1 | * | 3/2001 | Tanaka | 280/607 |
| 6,296,258 | B2 | * | 10/2001 | Higgins et al. | 280/14.22 |
| 6,302,411 | B1 | * | 10/2001 | Huffman et al. | 280/14.24 |
| 6,328,328 | B1 | * | 12/2001 | Finiel | 280/636 |
| 6,331,007 | B1 | * | 12/2001 | Bryce | 280/11.3 |
| 6,354,610 | B1 | * | 3/2002 | Dodge | 280/14.22 |
| 6,467,794 | B1 | * | 10/2002 | De France | 280/607 |

FOREIGN PATENT DOCUMENTS

| | | | | |
|---|---|---|---|---|
| WO | WO 9925434 | A1 * | 5/1999 | A63C/9/08 |

* cited by examiner

*Primary Examiner*—Brian L. Johnson
*Assistant Examiner*—Kelly Campbell
(74) *Attorney, Agent, or Firm*—Thelen Reid & Priest LLP; Adrienne Young

(57) ABSTRACT

A shock-absorbing apparatus disposed between a binding and a board has a bottom plate for coupling to the board, a top plate or binding platform to receive the binding, and bearing-biasing assemblies coupled between the bottom plate and the top plate. Each bearing-biasing assembly includes a bearing assembly and a biasing assembly where the bearing assembly is disposed coaxially with the biasing assembly. The bearing-biasing assembly is responsive to mechanical energy encountered by the binding platform or the board during use by enabling the binding platform to swivel or pivot from or move along an axis intersecting a top surface of the board.

68 Claims, 10 Drawing Sheets

SHOCK-ABSORBING APPARATUS

CROSS REFERENCE TO RELATED APPLICATION

This is a continuation-in-part of U.S. patent application Ser. No. 09/108,077, filed Jun. 30, 1998, and now U.S. Pat. No. 6,296,258 and entitled, "SNOWBOARD SHOCK-ABSORBING APPARATUS", in the name of inventors Michael Timothy Higgins and Robert John Caputo.

FIELD OF THE INVENTION

The present invention relates to a shock-absorbing apparatus that is compatible with a variety of boards and binding systems.

BACKGROUND OF THE INVENTION

Snowboarding and wakeboarding have seen tremendous growth in recent years. They are activities that can be enjoyed almost anywhere so long as there is suitable terrain, such as a snow/ice covered slope, mountainside, sculpted terrain (such as half-pipe embankments), a sand dune having a sufficient grade or a suitable lake or ocean. A user is attached to an approximately flat board ("board") which has an approximately flat bottom that allows it to slide down terrain or board through water. The board also has a front end ("tip"), back end ("tail"), a top surface, a bottom surface, and two sides which are typically bounded by parallel bottom side edges. The front end and back end may be symmetrically shaped. The front and back ends are relative terms—the front end is the end closest to the direction of travel, while the back end is the end farthest from the 20 direction of travel. The distance between the two sides defines the width of the board with the width much shorter than the length of the board, giving the board a high length to width ratio.

A user is coupled to the board through an attachment system that includes at least one binding and one boot. The orientation of the bindings, as in a snowboard or wakeboard, typically provide two stances although the stances may be modified by the user depending on the type of terrain and activity anticipated. The first stance, known in the boarder vernacular as a "regular foot" stance, includes having the user ride with the left foot placed closest to the tip or to the direction of travel. The second stance is sometimes referred to as the "goofy foot" stance and includes having the right foot placed closest to the tip or to the direction of travel. When using either one of two above stances, the terms, "toeside" edge or "heelside" edge, are sometimes used to refer to one of the two parallel bottom side edges. The "toeside" edge refers to the side edge nearest to the user's toes and the heelside edge refers to the side edge nearest to the user's heels. The bindings are attached to the board and typically remain within a fixed orientation during use. The bindings are attached near the top surface of the board, minimizing the amount of spacing between a user's boots and the top surface of the board.

The board is designed to provide various levels of flexibility, depending on the type of terrain or activity anticipated by the user. A stiff flexing board gives the user greater "feel" or feedback than does a softer flexing board, enabling the user to cut better turns. A stiffer board also permits the user to induce greater stress on the board, such as when racing, without the board distorting greatly, enhancing turning accuracy and responsiveness of the board. However, both types of boards tend to transfer mechanical energy, i.e., shocks, vibration and jitter caused by use and which vary depending on terrain or activity, are directly transferred to the user, increasing the user's level of fatigue and discomfort.

Accordingly, a need exists for a shock-absorbing apparatus that can absorb mechanical energy applied to a board or to a user, while remaining compatible with existing boards, bindings, and boots for a variety of "board" sports such as snowboarding, water skiing, snow skiing, wakeboarding, or skateboarding.

Moreover, a need exists for a shock-absorbing apparatus that can absorb mechanical energy applied to a board or to a user while enhancing a user's ability to cut turns on the board.

SUMMARY OF THE INVENTION

A shock-absorbing apparatus disposed between a binding and a board has a bottom plate for coupling to the board, a top plate or binding platform to receive the binding, and bearing-biasing assemblies coupled between the bottom plate and the top plate. Each bearing-biasing assembly includes a bearing assembly and a biasing assembly where the bearing assembly is disposed coaxially with the biasing assembly. The bearing-biasing assembly is responsive to mechanical energy encountered by the binding platform or the board during use by enabling the binding platform to swivel or pivot from or move along an axis intersecting a top surface of the board.

DETAILED DESCRIPTION

Embodiments of the present invention are described herein in the context of a shock-absorbing apparatus. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

The invention is described in use with a board such as a snowboard or a wakeboard. However, those of ordinary skill in the art will realize that the invention may be adapted and utilized in other types of sports such as water skiing, snow skiing, and skateboarding. For example, those of ordinary skill in the art will realize that the top plate, botton plate, and binding systems may vary between a sno ski and a snowboard. However, the bearing-biasing assembly may be adapted to the varying top plate, bottom plate,and/or binding system.

Figure 1:
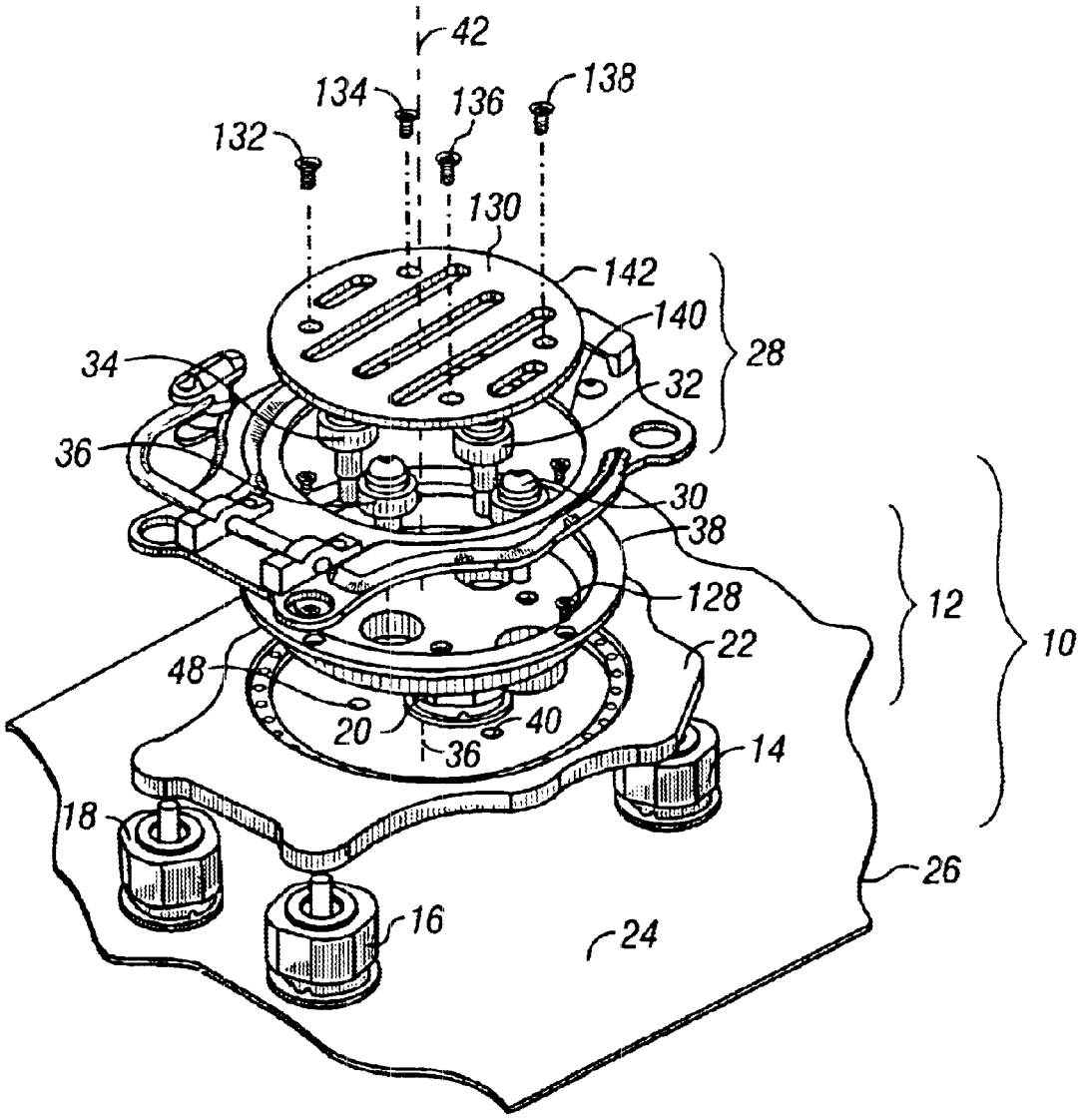
FIG. 1 is an exploded perspective view of a shock-absorbing apparatus mated to fit to a step-in binding and a board in accordance with a first specific embodiment of the present invention.
Figure 2:
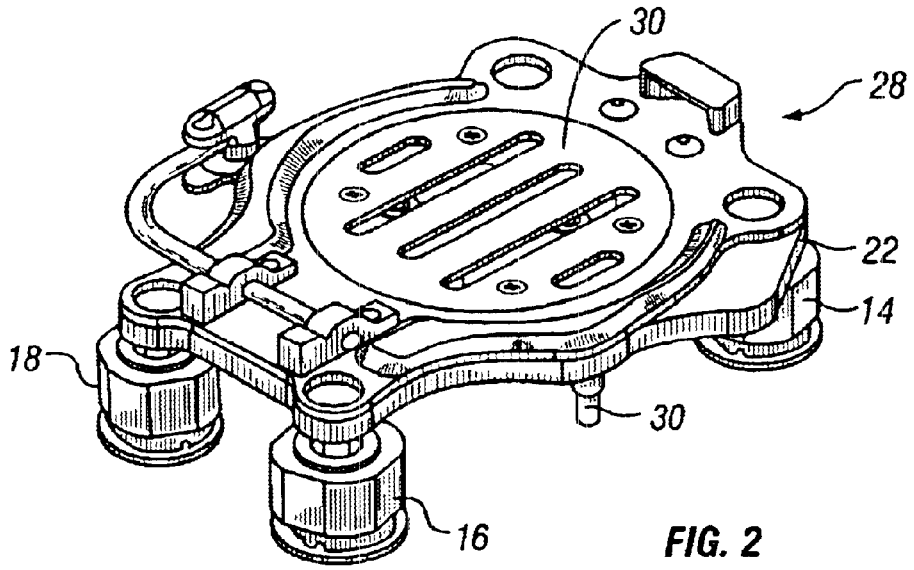
FIG. 2 is a perspective view of the shock-absorbing apparatus shown in FIG. 1.
Figure 3A:
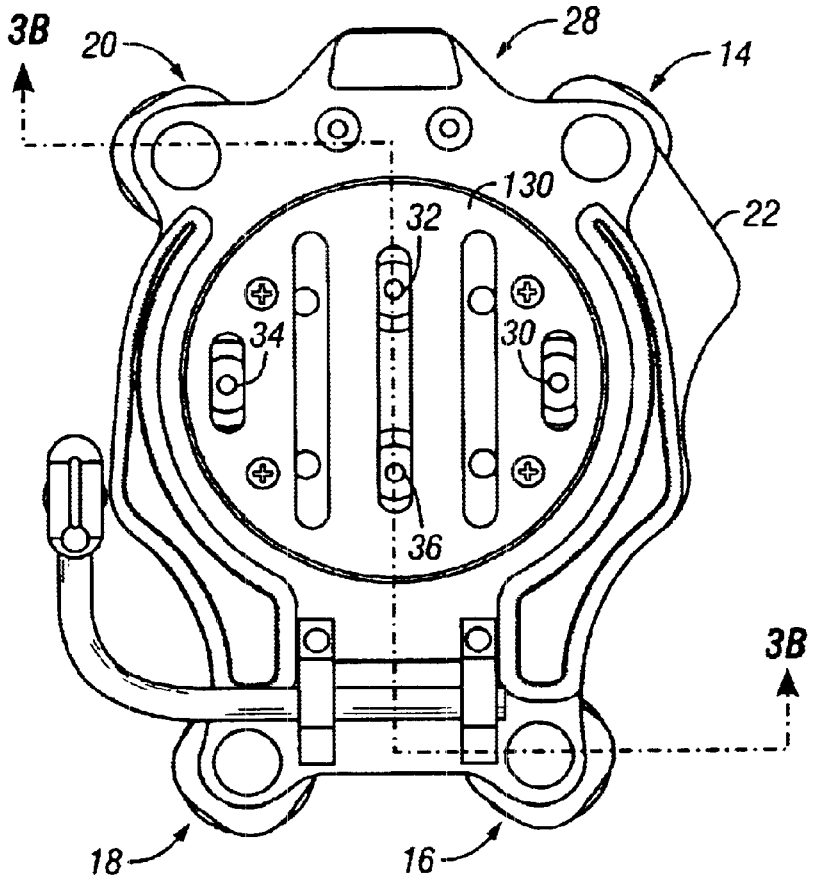
FIG. 3A is a top view of the shock-absorbing apparatus shown in FIG. 1.
Figure 3B:
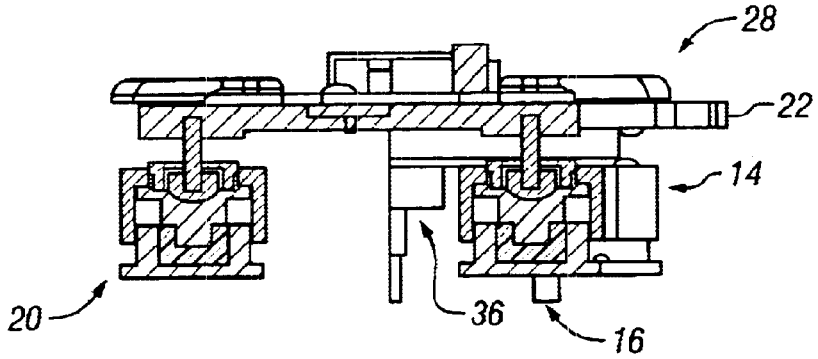
FIG. 3B is a sectional view taken along line 3B—3B of FIG. 3A of the shock-absorbing apparatus shown in FIG. 3A.

FIG. 1 is an exploded perspective view of a shock-absorbing apparatus mated to fit to a step-in binding and a board in accordance with a first specific embodiment of the present invention. FIG. 2 is a perspective view of the shock-absorbing apparatus shown in FIG. 1. FIG. 3A is a top view of the shock-absorbing apparatus shown in FIG. 1. FIG. 3B is a sectional view taken along line 3B—3B of FIG. 3A of the shock-absorbing apparatus shown in FIG. 3A.

Referring to FIGS. 1, 2, 3A and 3B, a shock-absorbing apparatus 10 in accordance with a first specific embodiment of the present invention is shown having a binding platform 12 and a four biasing assemblies 14, 16, 18, and 20. Biasing assemblies 14, 16, 18, and 20 are coupled between a plate 22 and a top surface 24 of a board 26. Binding platform 12 is shown coupled to board 26 and a step-in binding 28 through four bearing assemblies 30, 32, 34, and 36 which attach a hub 38 of platform 12 to a set of apertures 40 defined in a pattern in the board 26.

In accordance with the first specific embodiment of the present invention, bearing assemblies 30, 32, 34, and 36 permit platform 12 (and thus step-in binding 28 and its attached user) to pivot or swivel from and move along axis 42, while also providing a rugged construction design which will enable biasing assemblies 14 through 20 to absorb the shocks and bumps ("mechanical energy") encountered by apparatus 10 during use. Axis 42 is any axis which intersects top surface 24 although axis 42 may intersect top surface 24 at an approximately perpendicular angle. Besides providing ruggedness, bearing assemblies 30, 32, 34, and 36 also allow platform 10 to be mounted in a standard hole pattern found in many common boards, adding versatility to apparatus 10.

Figure 4A:
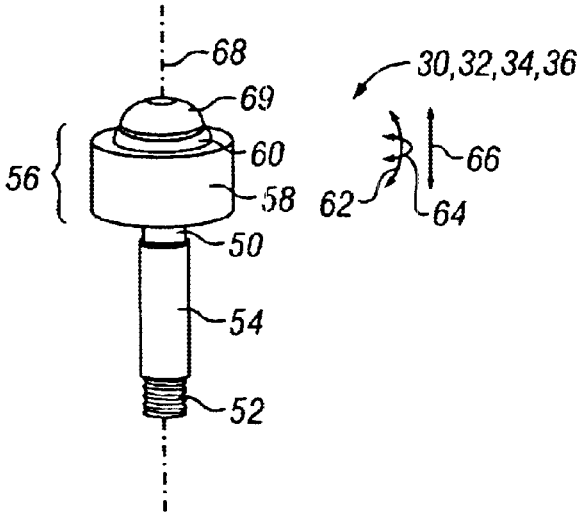
FIG. 4A is a perspective view of a bearing assembly in accordance with a first specific embodiment of the present invention.
Figure 4B:
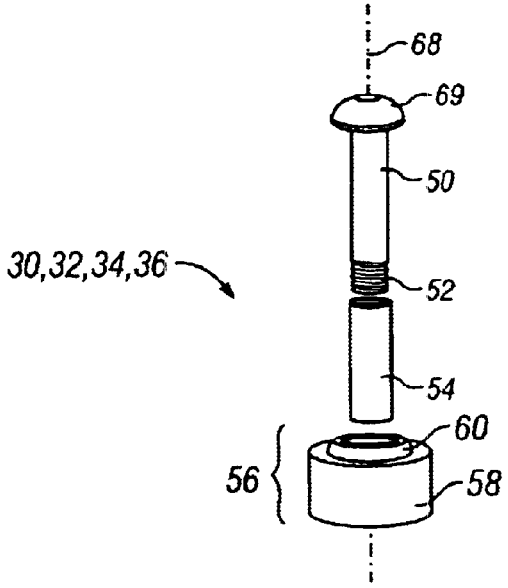
FIG. 4B is an exploded view of the bearing assembly shown in FIG. 4A.

FIG. 4A is a perspective view of a bearing assembly in accordance with a first specific embodiment of the present invention. FIG. 4B is an exploded view of the bearing assembly shown in FIG. 4A.

Referring now to FIGS. 4A and 4B, bearing assemblies 30, 32, 34, and 36 each include a bolt 50 having a threaded portion 52, a stand-off 54, and a spherical bearing 56. Spherical bearing 56 includes a sleeve 58 and a sphere 60 with a cylindrical cavity for which bolt 50 is placed, as shown. This enables sleeve 58 to swivel 62, rotate 64, and/or slide 66 along axis 68. Those of ordinary skill in the art will recognize the amount of movement along axis 68 is limited by a head portion 69 of bolt 50 and stand-off 54. Spherical bearings are known to those of ordinary skill in the art and are available from W. M. Berg, Inc., 499 Ocean Avenue of East Rockaway, N.Y. Each bearing assembly used is attached to platform 12 at sleeve 58 and to board 26 at threaded portion 52. This permits platform 12 and board 26 to swivel and move or slide along axis 42 (see FIG. 1).

In accordance with an alternative embodiment of the present invention, bearing assemblies 30, 32, 34, and 36 may be arranged to fit with non-standard hole patterns, such as that found on the well-known Burton™ snowboard or any wakeboard.

The number of biasing assemblies and bearing assemblies used and the pattern used to position the assemblies in accordance with the present invention are not intended to be limited in any way. Other configurations may be used that are within the scope and spirit of the herein disclosure and which may be evident to those of ordinary skill in the art.

Figure 5A:
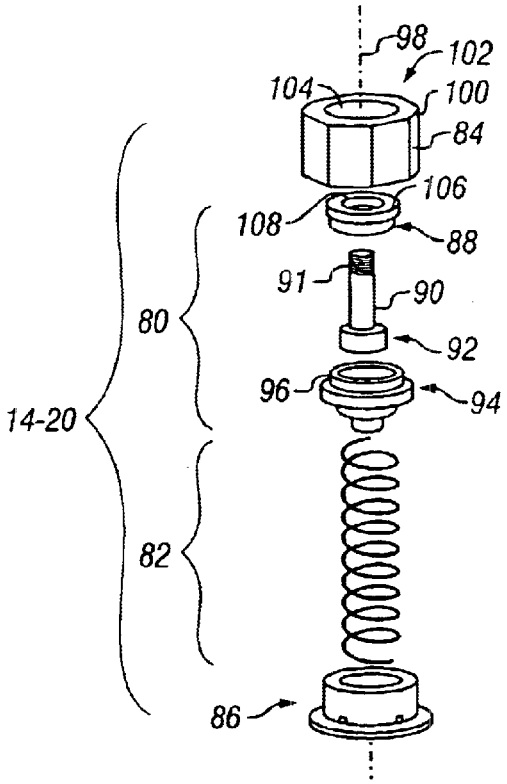
FIG. 5A is an exploded perspective view of a biasing assembly in accordance with a first specific embodiment of the present invention.

FIG. 5A is an exploded perspective view of a biasing assembly in accordance with a first specific embodiment of the present invention.

Referring to FIG. 5A, biasing assemblies 14, 16, 18, and 20 each include a swivel assembly 80 and a biasing element 82 which are bounded by a top portion 84 and a bottom portion 86. Top portion 84 and bottom portion 86 are sometimes referred to herein as a retainer and foot, respectively. Swivel assembly 80 includes a threaded lid 88, a coupler 90, and a socket 94 having a threaded outside surface 96 configured to receive lid 88.

Biasing element 82 may be any type of biasing element that can provide biasing along an axis 98 although in accordance with a presently preferred embodiment of the present invention biasing element 82 is a spiral spring. Spiral springs are known to those of ordinary skill in the art and are available from Smalley Steel Ring Company of Wheeling, Ill. The spiral spring used in accordance with one specific embodiment provides full compression at 52 pounds of force and is formed using a wire having a rectangular cross-section (not shown).

Figure 5B:
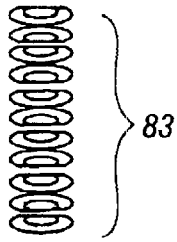
FIG. 5B is a perspective view of a biasing element for use with a biasing assembly in accordance with an alternative first specific embodiment of the present invention.

FIG. 5B is a perspective view of a biasing element for use with a biasing assembly in accordance with an alternative first specific embodiment of the present invention.

FIG. 5B is a perspective view of a biasing element 83 in accordance with an alternative embodiment of the present invention. Biasing element 83 includes at least eleven disc springs providing full compression at 52 pounds. Disc springs are known by those of ordinary skill in the art and are sometimes referred to as "Belleville springs." The disc springs described herein are available from Century Spring Corporation of Los Angeles, Calif.

The use of a spiral spring or disc springs as a biasing element is not intended to be limiting in any way but is illustrative of the type of biasing elements that may be used in the present invention. Other types of springs and biasing elements such as elastomeric components may be used without departing from the scope or spirit of the present invention.

The number of springs used is not intended to be limiting in any way. Those of ordinary skill in the art will recognize from this disclosure that any number of springs may be used, depending on the type of springs used and the size of biasing assembly used to house the springs, among other things.

When coupled to plate 22, biasing assemblies 14, 16, 18, and 20 provide shock absorbing properties to platform 12 (and hence to a user attached to platform 12 via binding 28). Each biasing assembly is coupled to a bottom surface 99 (see FIG. 7C) of plate 22 through the use of coupler 90 having a first end 91 and a swivel portion 92. Coupler 90 is fixed to plate 22 at first end 91. When received by socket 94, swivel portion 92 enables the biasing assembly to absorb mechanical energy transferred from board 26 through biasing element 82 at angles offset from axis 98. When combined with bearing assemblies 30, 32, 34, and 36 in FIG. 1, each swivel portion and socket with the bearing assemblies permit platform 12 to swivel at angles offset from axis 42.

In accordance with a first specific embodiment of the present invention, coupler 90 is a button head screw (not shown) having a button head portion and a threaded portion. The button head portion forms swivel portion 92 of coupler 90 and the threaded portion forms first end 91. The use of a button head screw is not intended to be limiting in any way. Other embodiments may be used such as a separate set screw (not shown) having a threaded first end and threaded second end and a separate swivel portion having a threaded portion for receiving the threaded second end of the separate screw. The first end of the set screw is fixed to plate 22 and the second end is fixed to the threaded portion of swivel portion 92.

Top portion 84 may have an inner threaded surface and bottom portion 86 may have an outer threaded surface top portion 84. Both threaded surfaces are sized to interlock with each other so that top portion 84 can be "screwed-on" to bottom portion 86. This not only enables top portion 84 and bottom portion 86 to retain socket 94 and biasing element 82, but provides a biasing element adjustment feature.

Specifically, top portion 84 has a first end 100 having an aperture 102 having a size defined by an inner edge 104. Lid 88 has top end 106 having a size defined by outer edge 108. The position along axis 98 of first end 100 determines the maximum travel of lid 88 (and hence the maximum travel of biasing element 82 along axis 98) and the amount of preset bias provided by biasing element 82. Thus, maximum travel and the amount of present bias provided by biasing element 82 may be selected simply by increasing or decreasing the amount top portion 84 is screwed onto bottom portion 86.

When used with bearing assemblies 30, 32, 34, and 36, biasing assemblies 14, 16, 18, and 20 enable binding platform 12 to swivel (as discussed above) and/or slide along axis 42 in a damped manner in response to mechanical energy, such as jolts, bumps, and vibration, encountered during use. This provides an independent suspension feature to platform 12 since board 26 can move along axis 42 (relative to platform 12) and do so even though its top surface 24 may be in a plane which is not perpendicular to axis 42.

This ability by platform 12 to swivel and/or slide along axis 42 by board 26 through bearing assemblies 30, 32, 34, and 36, while damped by biasing assemblies 14, 16, 18, and 20 results in a smoother ride and more precise handling characteristics for the user. The user's position along a plane intersecting axis 42, such as the plane provided by binding platform 28, does not change even though board 26 may move along and/or swivel about axis 42 during use. This gives the user better control of board 26, such as edge control, and better feedback as to the terrain traveled upon because the user's sense of position relative to the plane intersecting axis 42 is not unnecessarily affected by the shock absorbing movements of bearing assemblies 30, 32, 34, and 36 and biasing assemblies 16, 18, and 20.

In addition, binding platform 12, bearing assemblies 30, 32, 34, and 36, and biasing assemblies 14, 16, 18, and 20 together act to create a raised stance for the user. This reduces or eliminates the possibility of toe or heel drag during use, such as when making turns in soft snow or in rough terrain. The raised stance also enhances the ability of a user to transfer more power to the edges during turns.

In FIGS. 1, 2, 3A and 3B, since hub 38 is coupled to bearing assemblies 30, 32, 34, and 36, hub 38 remains rotationally fixed relative to axis 42. However, this aspect of the present invention is not intended to be in any way limiting. A single bearing assembly may be positioned along vertical axis 42, permitting hub 38 to not only to swivel and a move along axis 42 but also to rotate about axis 42. However, to ensure ruggedness and dependability, more than one bearing assembly is preferably used.

Figure 6:
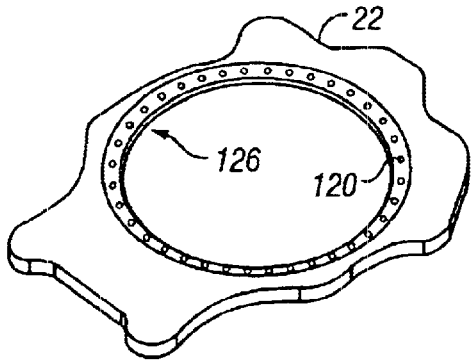
FIG. 6 is a perspective view of a plate forming part of a binding platform in a accordance with a first specific embodiment of the present invention.
Figure 7A:
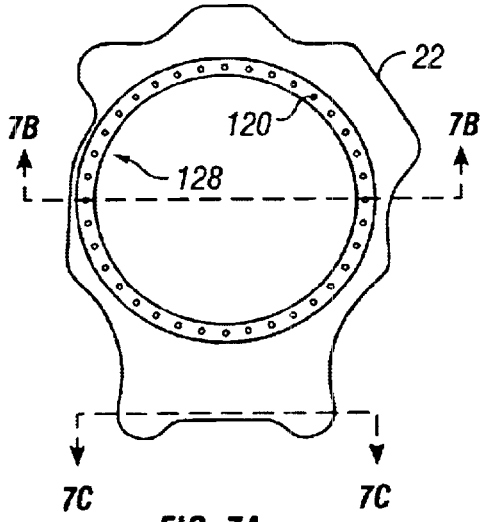
FIG. 7A is a top view of the plate shown in FIG. 6.
Figure 7B:
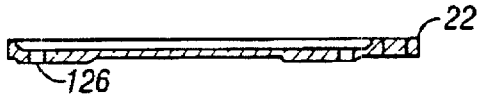
FIG. 7B is a sectional view taken along line 7B—7B of FIG. 7A.
Figure 7C:
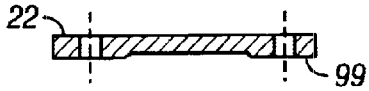
FIG. 7C is a sectional view taken along line 7C—7C of FIG. 7A.
Figure 8:
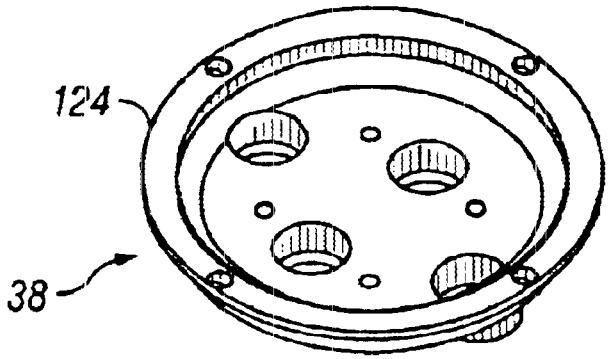
FIG. 8 is a perspective view of a hub forming part of a binding platform in accordance with a first specific embodiment of the present invention.
Figure 9A:
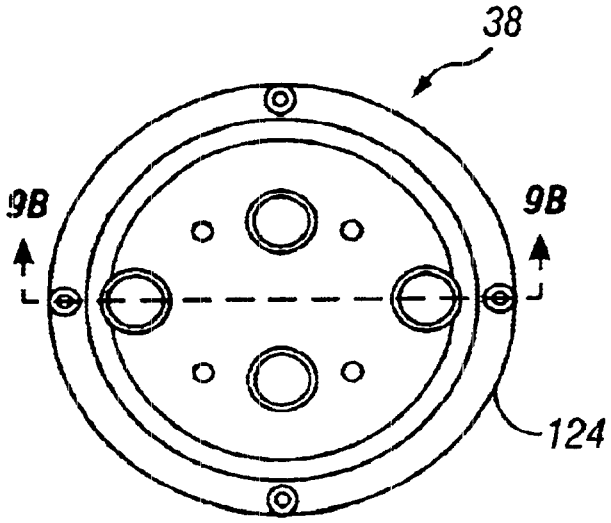
FIG. 9A is a top view of the hub of FIG. 8.
Figure 9B:
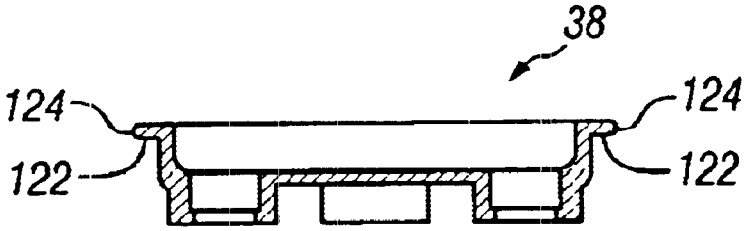
FIG. 9B is a sectional view taken along line 9B—9B of FIG. 9A.

FIG. 6 is a perspective view of a plate forming part of a binding platform in accordance with a first specific embodiment of the present invention. FIG. 7A is a top view of the plate shown in FIG. 6. FIG. 7B is a sectional view taken along line 7B—7B of FIG. 7A. FIG. 7C is a sectional view taken along line 7C—7C of FIG. 7A. FIG. 8 is a perspective view of a hub forming part of a binding platform in accordance with a first specific embodiment of the present invention. FIG. 9A is a top view of the hub of FIG. 8. FIG. 9B is a sectional view taken along line 9B—9B of FIG. 9A.

Referring now to FIGS. 6, 7A, 7B, 7C, 8, 9A and 9B, plate 22 includes a surface 120 which is configured to receive a flange 122 forming an outer edge 124 for hub 38. This permits plate 12 to rotate about axis 42 (see FIG. 1) even though hub 38 is rotationally fixed by bearing assemblies 30, 32, 34, and 36. Both surface 120 and flange 122 have a plurality of apertures 126 which are shaped to receive at least one screw, such as screw 128 in FIG. 1. This permits plate 22 to be rotated about axis 42 to a selected position and then set at that position by screw 128. Any number of screws may be used although at least four screws are used in a presently preferred embodiment of the present invention.

The use of a hub and plate in the manner described above is not intended to be limiting in any way. Those of ordinary skill in the art will recognize that binding platform 12 may be made into a single piece, more than two pieces, or any other number of pieces without departing from the inventive concepts described herein. For example, platform 12 may be integrally formed into a single piece which does not have a plate portion which may be selected to have a position about axis 42 but is fixed to a hub portion which is in turn, fixed to board 26. The user's stance may be adjusted by rotating step-in binding 28 to a selected position and then held in that position by attaching binding disc 130 (see FIG. 1) to hub 38 using screws 132, 134, 136 and 138 to attach to a hole pattern formed on hub 38. The hole pattern may be a standard hole pattern which matches the hole patterns on binding disc 130, although other hole patterns may be used, such as a hole pattern found on a Burton™ binding.

Those of ordinary skill in the art will now recognize that step-in binding 28 includes teeth (not shown) which form edge 140 and binding disc 130 also includes teeth (not shown) at its outer edge 142. This enables step-in binding 128 to be interlocked with binding disc 130 when binding disc 130 is attached using screws 132, 134,136, and 138 to threaded holes on hub 38. In accordance with a specific embodiment of the present invention, screws 132, 134, 136, and 138 are flat head screws although any convenient type of screw or fastener may be used without departing from the scope or spirit of the herein disclosure.

Figure 10:
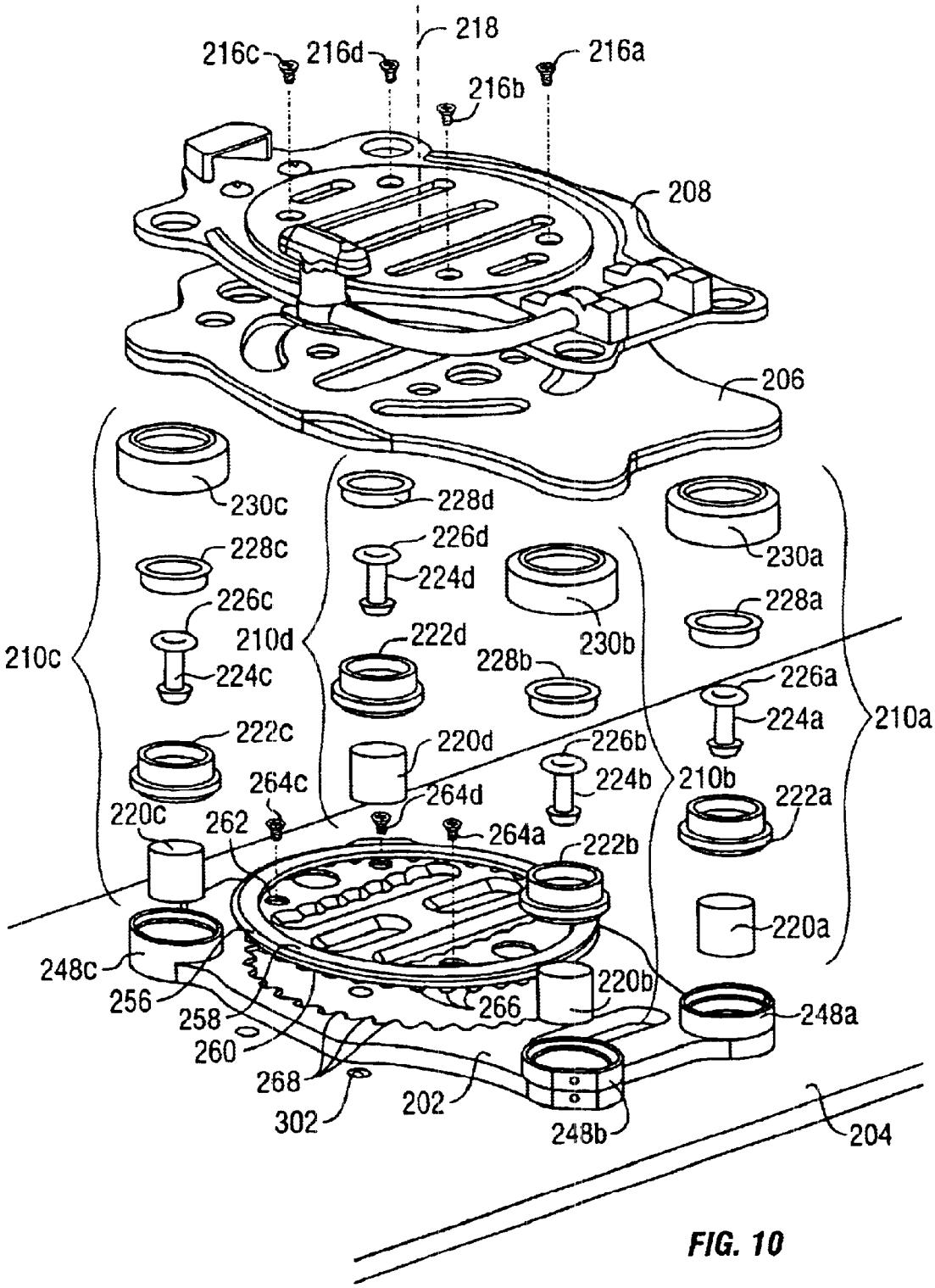
FIG. 10 is an exploded perspective view of a shock-absorbing apparatus mated to fit to a binding and a board in accordance with a second specific embodiment of the present invention.
Figure 11:
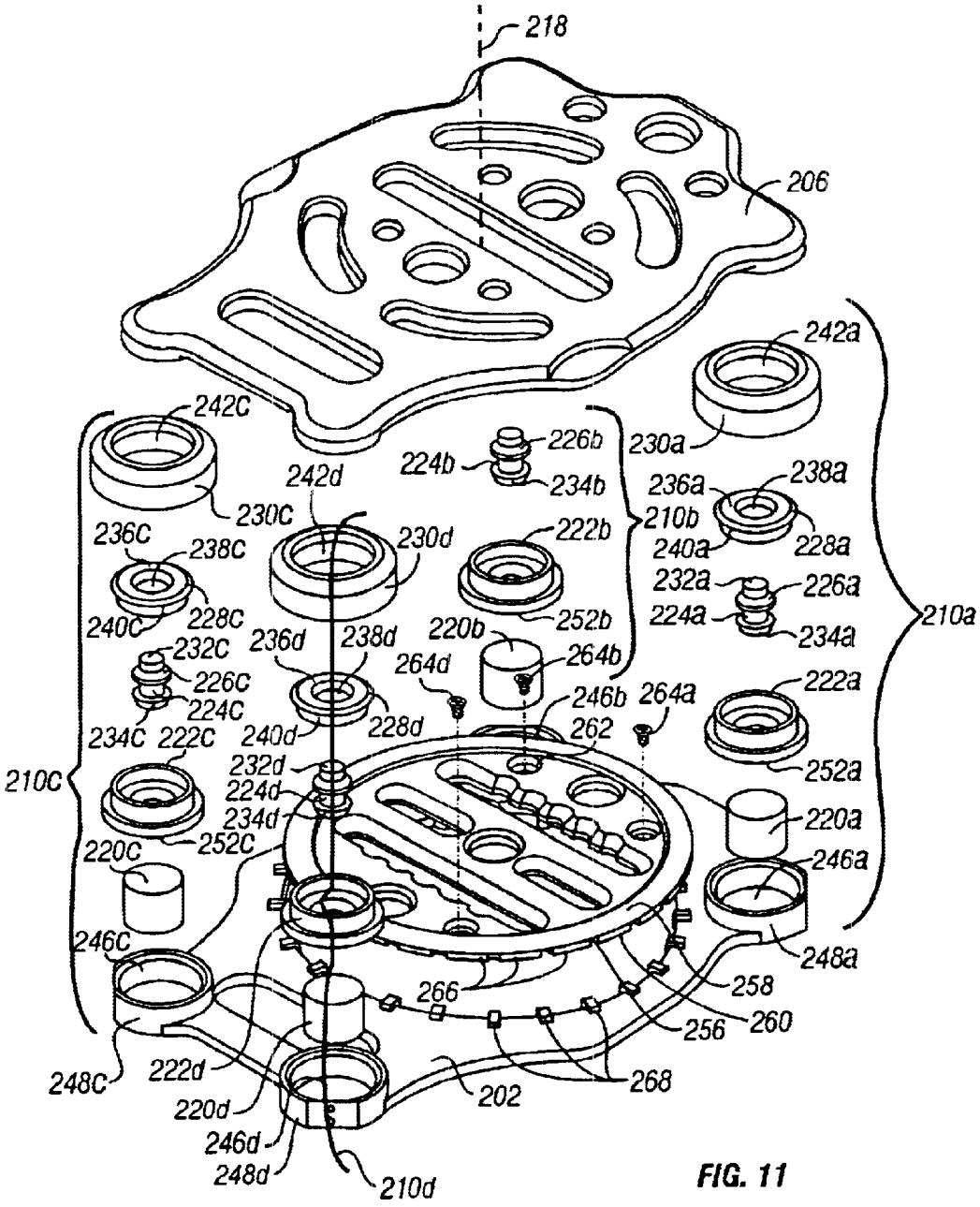
FIG. 11 is another exploded perspective of the apparatus of FIG. 10 view without the binding or board being shown.
Figure 12:
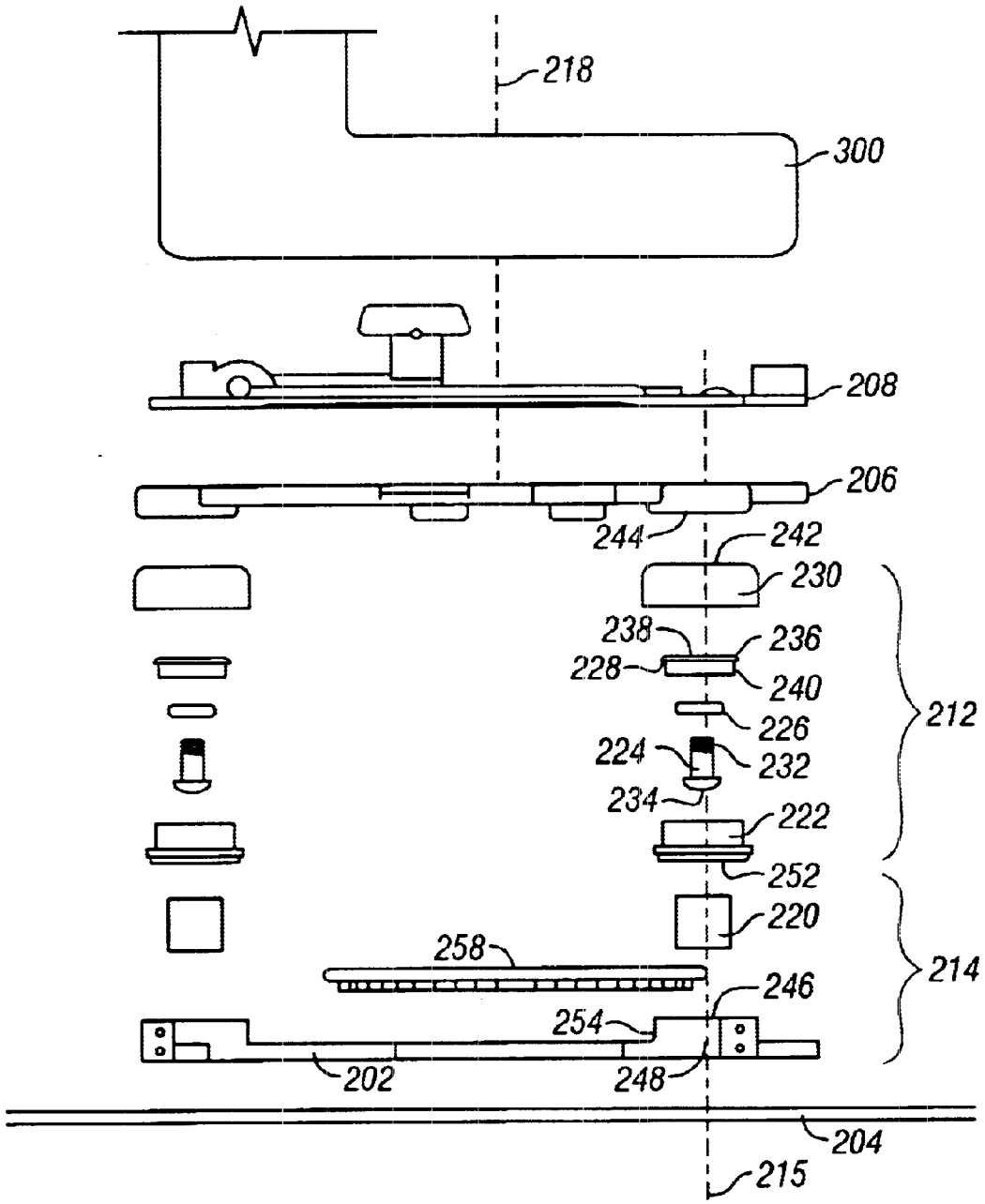
FIG. 12 is an exploded side elevational view of the apparatus of FIG. 10 showing the orientation of a boot, binding, shock-absorbing apparatus and board in accordance with a second specific embodiment of the present invention.
Figure 13:
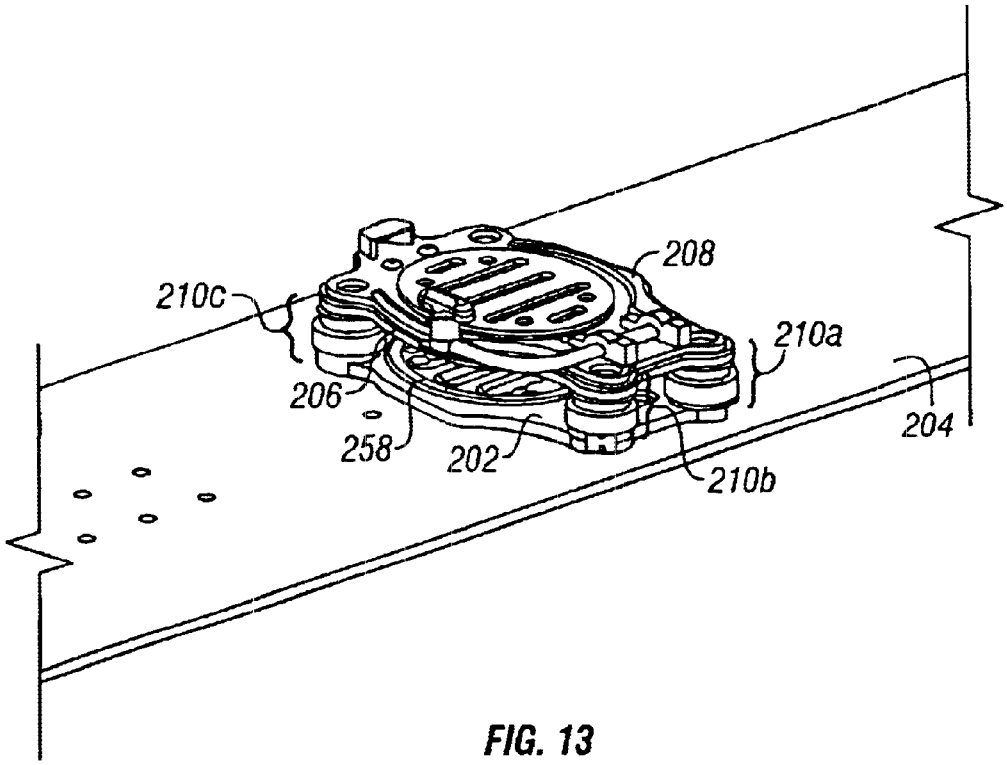
FIG. 13 is a perspective view of the apparatus of FIG. 10 assembled onto a board.
Figure 14:
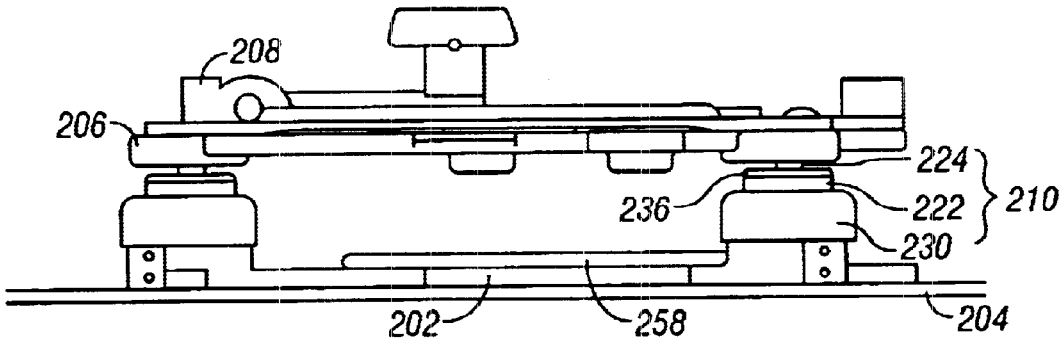
FIG. 14 is a side elevational view of the assembly shown in FIG. 13.

A second specific embodiment of the present invention is illustrated in FIGS. 10, 11, 12, 13 and 14. FIG. 10 is an exploded perspective view of a shock-absorbing apparatus mated to fit to a step-in binding and a board in accordance with a second specific embodiment of the present invention. FIG. 11 is another exploded perspective of the apparatus of FIG. 10 view without the step-in binding or board being shown. FIG. 12 is an exploded side elevational view of the apparatus of FIG. 10 showing the orientation of a boot, binding, shock-absorbing apparatus and board in accordance with a second specific embodiment of the present invention. FIG. 13 is a perspective view of the apparatus of FIG. 10 assembled onto a board. FIG. 14 is a side elevational view of the assembly shown in FIG. 13.

A novel shock-absorbing apparatus is shown having a bottom plate 202 coupled to the board 204, a top plate 206 to receive the binding 208, and four bearing-biasing assemblies 210*a*, 210*b*, 210*c*, and 210*d*. Each of the bearing-biasing assemblies (210*a*, 210*b*, 210*c*, and 210*d*) have a bearing assembly 212 (shown in FIG. 12) and a biasing assembly 214 (shown in FIG. 12) where the bearing assembly 212 is disposed coaxially about the same axis 215 as biasing assembly 214 and the biasing assembly 214 is oriented to press against the bottom plate 202. The top plate 206 is shown coupled to a step-in binding 208 that may be connected to the top plate 206 using four connectors 216*a*, 216*b*, 216*c*, and 216*d*, such as a screw. The boot 300 of a user is then attached to the binding 208 as shown in FIG. 12. Those of ordinary skill in the art will realize that any type of binding, such as strap-in bindings, may be used and as such, the number or type of connectors may vary and is not intended to be limiting. Moreover, the number of assemblies used in this invention is not intended to be limiting. Furthermore, as previously described, the bottom plate and top plate may vary based pon the sport such as skiing or skateboarding. For example the hub of the bottom plate may not be necessary when the bearing-biasing assembly is used on a ski board. Thus, those of ordinary skill in the art will realize that the present invention may be addapted for use in any other sporting apparatus.

The bearing assemblies 212 and biasing assemblies 214 are coupled between the top plate 206 and the bottom plate 202. In accordance with the second specific embodiment of the present invention, the bearing assemblies 212 permit the top plate 206 (and thus the step-in binding 208 and its attached user) to pivot or swivel from and move along axis 218, while also providing a rugged construction design which will enable biasing assemblies 214 to absorb the shocks and bumps (mechanical energy) encountered by the apparatus during use. Axis 218 is any axis that intersects the top surface of the board 204 at an approximately perpendicular angle. Besides providing ruggedness, bearing assemblies 212 also provide stability for the biasing element 220 in the biasing assemblies 214.

As shown in FIGS. 10, 11 and 12, the bearing assemblies 212 each include a socket 222, a connector 224, an O-ring 226, a lid 228, and a top portion or retainer 230. The connector 224, such as a bolt, has a threaded portion 232 and a head 234. The head 234 is placed within the socket 222 and the 0-ring 226 is placed on the connector 222 between the head 234 and threaded portion 232. The lid 230 has a top surface 236, having an aperture 238, and a bottom surface 240. The top surface 236 is larger in diameter than the bottom surface 240 such that when the lid 228 is placed on top of the socket 222, the bottom surface 240 of the lid 228 fits within the socket 222 thereby forming a cylindrical cavity between the lid 228 and socket 222. The connector 224 is placed within the cylindrical cavity such that the threaded portion of the connector 232 extends through the aperture of the lid 238 and the connector head 234 and 0-ring 226 fits within the cylindrical cavity. The 0-ring 226 placed between the connector head 234 and threaded portion 232 fills the cylindrical cavity between the lid 228 and the socket 222 and allows the connector 224 to pivot or swivel from and move along axis 218 especially when one side of the bearing assemblies is fully adjusted, as further described below. The top portion or retainer 230 has a circular threaded inner surface 242 of a size large enough to encompass the lid 228 and socket 222. Those of ordinary skill in the art will recognize that any connector may be used, such as a screw, and will realize that the amount of movement along axis 218 is limited by the connector head. Each bearing assembly 212 is attached to an aperture 244 in the top plate 206 at threaded portion 232. This permits the user to swivel and move or slide along axis 218.

The number of biasing assemblies and bearing assemblies used and the pattern used to position the assemblies in accordance with this embodiment of the invention are not intended to be limiting in any way. Other configurations may be used that are within the scope and spirit of the herein disclosure and which may be evident to those of ordinary skill in the art.

The biasing assemblies 214 are coaxial with the bearing assemblies 212 as shown in FIG. 12. Each biasing assembly 214 includes a biasing element 220 that is bounded by the socket 222 and a mating groove 246 of a bottom portion 248 in the bottom plate 202. The biasing element 220 may be any type of biasing element that can provide biasing along axis 218, such as the elastomeric cylindrical biasing element, which may be made of polyurethane, as shown in FIG. 12. Those of ordinary skill in the art will realize that other biasing elements may be used, such as the spiral spring as shown in FIG. 5A or the Belville Spring of FIG. 5B. The elastomeric cylindrical biasing element may provide full compression at various pounds of force such as between 75–135 pounds, 135–225 pounds, or 225–300 pounds depending upon, for example, the weight of the user.

The biasing element 220 mates with a groove in the bottom surface 252 of the socket 222 and a mating groove 246 of the bottom plate 202. The top portion or retainer 230 has a threaded inner surface 242 and the bottom portion 248 has an outer threaded surface 254 such that both surfaces are sized to interlock with each other so that the top portion 230 can be "screwed-on" to the bottom portion 248. When coupled to the top plate 206 through the connection of top portion 230 and bottom portion 248, biasing assembly 214 provides shock-absorbing properties to the top plate 206 (and hence to the user attached to the top plate via the binding). The position along axis 218 of the top portion 230 determines the maximum travel of the biasing element 220 along axis 218. Thus, the maximum travel and the amount of present bias provided by the biasing element 220 may be selected simply by increasing or decreasing the amount the top portion 230 is screwed onto the bottom portion 248.

The diameter of the top portion 230 and bottom portion 248 may vary based upon the biasing element used. However, both should be of a size large enough to allow the biasing element to displace throughout the cavity when force is applied onto the biasing element.

FIGS. 13 and 14 show the apparatus assembled on a board 204. The biasing assembly 214 not only enables top portion 230 and bottom portion 248 to retain biasing element 220 and provide a biasing element adjustment feature, but allows the user to adjust the height of the apparatus. This reduces or eliminates the possibility of toe or heel drag during use, such as when making turns in soft snow or in rough wakes. The additional height also enhances the ability of a user to transfer more power to the edges during turns. Furthermore, this embodiment allows the user the freedom to choose what height, if any, that is comfortable for the user. For example, a user may decide to only raise one side of the apparatus such as assemblies 210*a* and 210*d* and lower the opposite side of the apparatus such as assemblies 210*b* and 210*c*.

The number of biasing elements used is not intended to be limiting in any way. Those of ordinary skill in the art will recognize from the herein disclosure that any number of springs may be used, depending on the type of springs used and the size of the biasing assembly used to house the springs, among other things.

Bearing assemblies 212 and biasing assemblies 214 enable a board to swivel (as discussed above) and/or slide along axis 218 in a damped manner in response to mechanical energy, such as jolts, bumps, and vibrations, encountered during use. This provides an independent suspension feature to the board since the board can move along axis 218 (relative to the platform) and do so even though the top plate may be in a plane which is not perpendicular to axis 218. Furthermore, as described above, this allows a user to have better control of the board, such as edge control, and better feedback as to the terrain traveled upon because the user's sense of position relative to the plane intersecting axis 218 is not unnecessarily affected by the shock absorbing movements of the bearing assemblies and biasing assemblies.

As shown in FIGS. 10 and 11, the bottom plate 202 has a hub 256 that has a top surface 258, a bottom surface 260, and at least one aperture 262. The hub 256 is coupled to the board 204 by four connectors 264*a*, 164*b*, 264*c*, and 264*d*, such as a screw, which goes through aperture 262 and holes 302 in the board 204. The hub 256 thus remains rotationally fixed relative to axis 218. The number of connectors 264*a*, 264*b*, 264*c*, and 264*d* used to secure the hub 256 to the board 204 is not intended to be limiting in any way. A single connector may be used to connect the hub 256 to the board 204, however, to ensure ruggedness and dependability, more than one connector is preferred.

The bottom surface 260 of the hub 256 has a plurality of teeth 266 to with mate with a plurality of grooves 268 in a circularly shaped surface of the bottom plate 202. The connection between the teeth 266 and groove 268 allows the bottom plate 202 (and thus the apparatus) to be securely fixed to the board 204. Furthermore, this allows bottom plate 202 to rotate about axis 218 by unconnecting the connectors 264*a*, 264*b*, 264*c* and 264*d*, lifting hub 256 (and thus releasing the teeth 266 from the grooves 268), and rotating bottom plate 202 to the desired position. The hub 256 is then reconnected to the bottom plate 202 via the mating of the teeth 266 and grooves 268 and to the board 204 via the connectors 264*a*, 264*b*, 264*c* and 264*d*. The teeth 266 and groove 268 connection prevents the bottom plate 202 from rotating about axis 218 and secures bottom plate 202 (and thus the apparatus) to the board 204.

Figure 15:
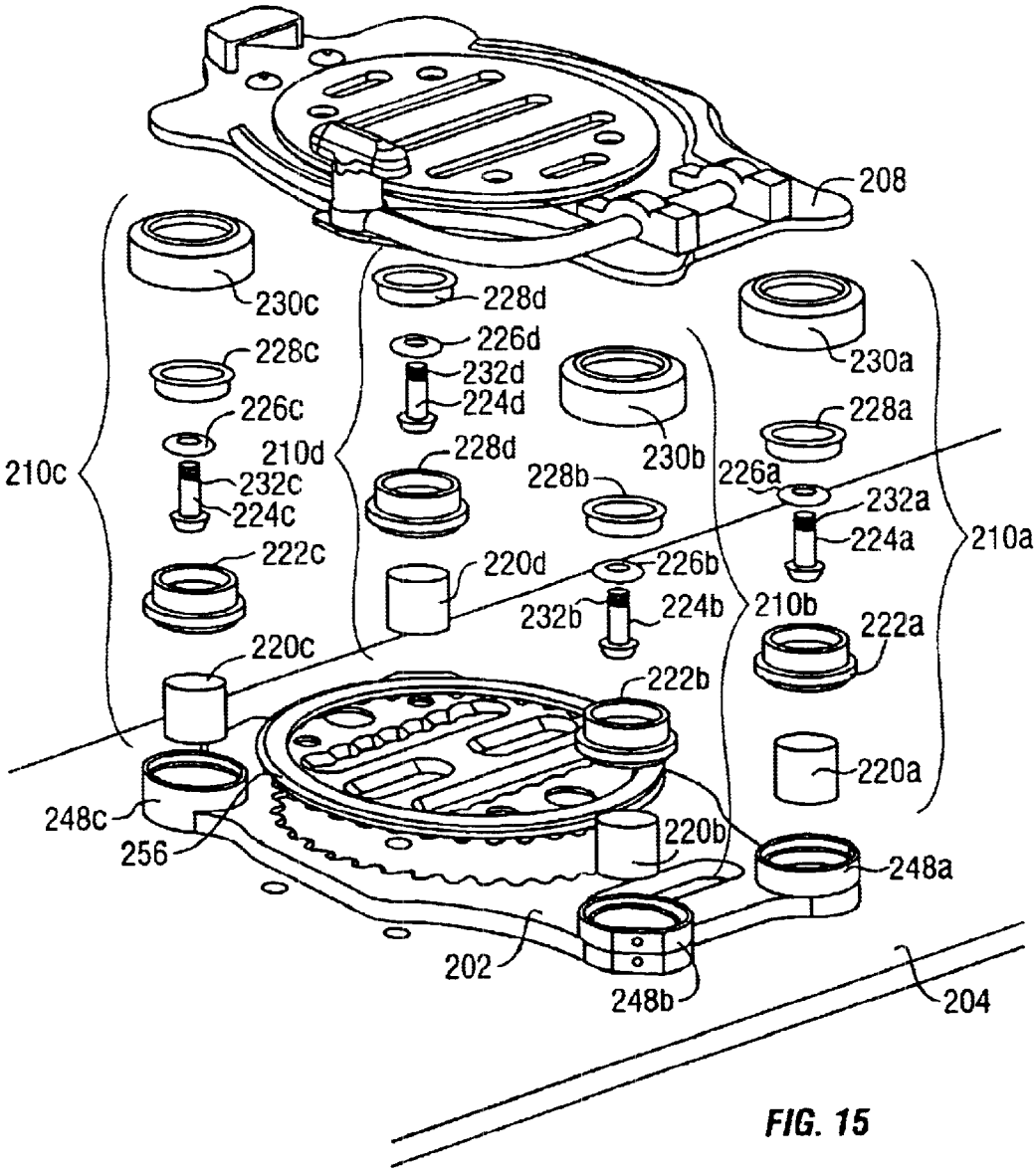
FIG. 15 is an exploded perspective view of a shock-absorbing apparatus in accordance with a third specific embodiment of the preset invention.

FIG. 15 is an exploded perspective view of a shock-absorbing apparatus in accordance with a third specific embodiment of the preset invention.

In yet another preferred embodiment of the present invention as shown in FIG. 15, the bearing-biasing assemblies 210*a*, 210*b*, 210*c* and 210*d* are attached directly to the bindings 208 at an aperture (not shown) in the binding 208 with the threaded portion 232*a*, 232*b*, 232*c* and 232*d*. This eliminates the redundancy of having a top plate for the apparatus and the bottom plate of the binding. As shown in FIG. 15, there are four bearing-biasing assemblies 210*a*, 210*b*, 210*c* and 210*d*. The number of assemblies are not intended to be limiting and any number of assemblies may be used.

While embodiments and applications of this invention have been shown and described, it would be apparent to those skilled in the art having the benefit of this disclosure that many more modifications than mentioned above are possible without departing from the inventive concepts herein. The invention, therefore, is not to be restricted except in the spirit of the appended claims.

What is claimed is:

1. A shock-absorbing apparatus for coupling a binding to a board, the apparatus comprising:

a bottom plate for coupling to said board;

a top plate to receive the binding; and a plurality of assemblies coupling said bottom plate to said top plate, wherein each of said plurality of assemblies further comprises a bearing assembly and a biasing assembly, said bearing assembly disposed coaxially with said biasing assembly, said biasing assembly oriented to press against said bottom plate; and wherein said bearing assembly includes a top portion for engaging said bottom plate and a connecting assembly having a lid and a socket, the lid and socket forming a first cavity in said connecting assembly, said first cavity having a connector disposed therein, the connector having an attachment portion protruding through said lid to engage an aperture in said top plate.

2. The apparatus in accordance with claim 1 wherein said connector further comprises a head portion opposite said attachment portion, said head portion encapsulated by said lid and said socket.

3. The apparatus of claim 1 wherein said biasing assembly includes said socket and a bottom portion on said bottom plate.

4. The apparatus in accordance with claim 3, wherein said biasing assembly further includes a biasing element disposed between said socket and said bottom portion.

5. An apparatus in accordance with claim 4, wherein said biasing element comprises at least one spiral spring.

6. An apparatus in accordance with claim 4, wherein said biasing element provides full compression at a range of between 100 to 300 pounds.

7. An apparatus in accordance with claim 4, wherein said biasing element is made of an elastomeric material.

8. The apparatus in accordance claim 4, wherein said top portion and said bottom portion are threaded so as to engage one another to form a second cavity in said biasing assembly, said second cavity having said bearing and biasing assembly.

9. An apparatus in accordance with claim 3, wherein said top portion has a first end and a second end, said first end having an inner edge defining a first aperture and said second end having an inner edge defining a second aperture, said bottom portion having a first end having an inner edge defining a third aperture, and said socket having a first outer edge and a second outer edge wherein said first outer edge is smaller in diameter than said second outer edge, wherein said first aperture is of a size allowing said first outer edge of said socket to extend through said first end while of a size precluding said second outer edge of said socket from extending through said first end, said second aperture is of a size allowing said second end of said socket to extend through said second aperture, and said third aperture is of a size sufficient to receive said biasing element.

10. An apparatus in accordance with claim 9, wherein said bottom portion of said biasing assembly further includes an outer edge of a size sufficient to fit within said second aperture of said top portion.

11. An apparatus in accordance with claim 10, wherein said top portion further includes a threaded inner surface bounded by said second aperture and said bottom portion has a threaded outer surface bounded by said outer edge, said threaded inner surface interlocking with said threaded outer surface of said bottom portion.

12. An apparatus in accordance with claim 9, wherein the distance between said first end of said top portion and said second end of said top portion defines a minimum height between said bottom plate and said top plate.

13. A shock-absorbing apparatus for coupling a binding to a board, the apparatus comprising:

a bottom plate for coupling to said board; and a plurality of assemblies coupling said bottom plate to said binding, wherein each of said plurality of assemblies further comprises a bearing assembly and a biasing assembly, said bearing assembly disposed coaxially with said biasing assembly, said biasing assembly oriented to press against said bottom plate, wherein said bearing assembly includes a top portion for engaging said bottom plate and a connecting assembly having a lid and a socket, the lid and socket forming a first cavity in said connecting assembly, said first cavity having a connector disposed therein, the connector having an attachment portion protruding through said lid and engaging an aperture in said binding.

14. An apparatus in accordance with claim 13, wherein said connector further comprises a head portion opposite said attachment portion, said head portion encapsulated by said lid and said socket.

15. The apparatus of claim 13, wherein said biasing assembly includes said socket and a bottom portion on said bottom plate.

16. The apparatus in accordance with claim 15, wherein said biasing assembly further includes a biasing element disposed between said socket and said bottom portion.

17. An apparatus in accordance with claim 16, wherein said biasing element comprises at least one spiral spring.

18. An apparatus in accordance with claim 16, wherein said biasing element provides full compression at a range of between 100 to 300 pounds.

19. An apparatus in accordance with claim 16, wherein said biasing element is made of an elastomeric material.

20. The apparatus in accordance with claim 16, wherein said top portion and said bottom portion are threaded so as to engage one another to form a second cavity in said biasing assembly, said second cavity having said bearing assembly and said biasing element disposed therein.

21. An apparatus in accordance with claim 15, wherein said top portion has a first end and a second end, said first end having an inner edge defining a first aperture and said second end having an inner edge defining a second aperture, said bottom portion having a first end having an inner edge defining a third aperture, and said socket having a first outer edge and a second outer edge wherein said first outer edge is smaller in diameter than said second outer edge, wherein said first aperture is of a size allowing said first outer edge of said socket to extend through said first end while of a size precluding said second outer edge of said socket from extending through said first end, said second aperture is of a size allowing said second end of said socket to extend through said second aperture, and said third aperture is of a size sufficient to receive said biasing element.

22. An apparatus in accordance with claim 21, wherein said bottom portion of said biasing assembly further includes an outer edge of a size sufficient to fit within said second aperture of said top portion.

23. An apparatus in accordance with claim 22, wherein said top portion further includes a threaded inner surface bounded by said second aperture and said bottom portion has a threaded outer surface bounded by said outer edge, said threaded inner surface interlocking with said threaded outer surface of said bottom portion.

24. An apparatus in accordance with claim 21, wherein the distance between said first end of said top portion and said second end of said top portion defines a minimum height between said bottom plate and said binding.

25. A shock-absorbing apparatus for coupling a binding to a board, the apparatus comprising:

a bottom plate for coupling to said board; and a plurality of assemblies coupling said bottom plate to said binding, wherein each of said plurality of assemblies further comprises a bearing assembly and a biasing assembly, said bearing assembly disposed coaxially with said biasing assembly, said biasing assembly oriented to press against said bottom plate, wherein said bottom plate includes a circular shaped hub having a bottom surface and a top surface, said bottom surface having a plurality of grooves to receive a plurality of teeth on a circularly shaped surface of said bottom plate to secure said bottom plate to the board, the circularly shaped surface being rotatable about the hub portion.

26. The apparatus in accordance with claim 25, wherein said hub includes at least one aperture for mounting said hub to the board.

27. A method for coupling a binding to aboard, comprising:

coupling a bottom plate to said board;

connecting a top plate to said binding; and attaching a plurality of assemblies between said bottom plate and said top plate to couple said bottom plate to said top plate, wherein each of said plurality of assemblies further comprises a bearing assembly and a biasing assembly, said bearing assembly disposed coaxially with said biasing assembly, said biasing assembly oriented to press against said bottom plate, wherein said bearing assembly includes a top portion and a connecting assembly having a lid and a socket.

28. The method of claim 27, further comprising engaging said top portion with said bottom plate thereby forming a first cavity in said connecting assembly with said lid and said socket.

29. The method of claim 28, further comprising disposing a connector within said first cavity, said connector having an attachment portion and a head portion, said attachment portion protruding through said lid to engage an aperture in said top plate, said head portion encapsulated by said lid and said socket.

30. The method of claim 28, wherein said biasing assembly includes disposing a biasing element between said socket and a bottom portion on said bottom plate.

31. The method of claim 30, wherein said biasing element comprises at least one spiral spring.

32. The method of claim 31, wherein said biasing element provides full compression at a range of between 100 to 300 pounds.

33. The method of claim 31, wherein said biasing element is made of an elastomeric material.

34. The method of claim 30 further including engaging said top portion and said bottom portion thereby forming a second cavity to encapsulate said bearing assembly and said biasing assembly.

35. The method of claim 30, wherein said top portion has a first end and a second end, said first end having an inner edge defining a first aperture and said second end having an inner edge defining a second aperture, said bottom portion having a first end having an inner edge defining a third aperture, and said socket having a first outer edge and a second outer edge wherein said first outer edge is smaller in diameter than said second outer edge, wherein said first aperture is of a size allowing said first outer edge of said socket to extend through said first end while of a size precluding said second outer edge of said socket from extending through said first end, said second aperture is of a size allowing said second end of said socket to extend through said second aperture, and said third aperture is of a size sufficient to receive said biasing element.

36. The method of claim 35, wherein said bottom portion of said biasing assembly further includes an outer edge of a size sufficient to fit within said second aperture of said top portion.

37. The method of claim 34 further comprising mounting a circular shaped hub to said board, said circular shaped hub having a bottom surface and a top surface, said bottom surface having a plurality of grooves to receive a plurality of teeth on a circularly shaped surface of said bottom plate to secure said bottom plate to the board, the circularly shaped surface being rotatable about the hub portion.

38. A method for coupling a binding to a board, comprising:

coupling a bottom plate to said board; and attaching a plurality of assemblies between said bottom plate and said binding to couple said bottom plate to said binding, wherein each of said plurality of assemblies further comprises a bearing assembly and a biasing assembly, said bearing assembly disposed coaxially with said biasing assembly, said biasing assembly oriented to press against said bottom plate, wherein said bearing assembly includes a top portion and a connecting assembly having a lid and a socket.

39. The method of claim 38 further comprising engaging said lid and said socket thereby forming a first cavity in said connecting assembly.

40. The method of claim 39 further comprising, disposing a connector within said first cavity, said connector having an attachment portion and a head portion, said attachment portion protruding through said lid and engaging an aperture in said top plate, said head portion encapsulated by said lid and said socket.

41. The method of claim 39, wherein said biasing assembly includes disposing a biasing element between said socket and a bottom portion on said bottom plate.

42. The method of claim 41, wherein said biasing element comprises at least one spiral spring.

43. The method of claim 41, wherein said biasing element provides full compression at a range of between 100 to 300 pounds.

44. The method of claim 41, wherein said biasing element is made of an elastomeric material.

45. The method of claim 41 further including engaging said top portion and said bottom portion thereby forming a second cavity to encapsulate said biasing assembly and said bearing assembly.

46. The method of claim 40, wherein said top portion has a first end and a second end, said first end having an inner edge defining a first aperture and said second end having an inner edge defining a second aperture, said bottom portion having a first end having an inner edge defining a third aperture, and said socket having a first outer edge and a second outer edge wherein said first outer edge is smaller in diameter than said second outer edge, wherein said first aperture is of a size allowing said first outer edge of said socket to extend through said first end while of a size precluding said second outer edge of said socket from extending through said first end, said second aperture is of a size allowing said second end of said socket to extend through said second aperture, and said third aperture is of a size sufficient to receive said biasing element.

47. The method of claim 46, wherein said bottom portion of said biasing assembly further includes an outer edge of a size sufficient to fit within said second aperture of said top portion.

48. A shock-absorbing apparatus for coupling a binding to a board, the apparatus comprising:

means for coupling a bottom plate to said board;

means for connecting a top plate to said binding; and means for attaching a plurality of assemblies between said bottom plate and said top plate to couple said bottom plate to said top plate, wherein each of said plurality of assemblies further comprises a bearing assembly and a biasing assembly, said bearing assembly disposed coaxially with said biasing assembly, said biasing assembly oriented to press against said bottom plate, wherein said bearing assembly includes a top portion and a connecting assembly having a lid and a socket.

49. The apparatus of claim 48 further comprising means for engaging said top portion with said bottom plate thereby forming a first cavity in said connecting assembly with said lid and said socket.

50. The apparatus of claim 49 further comprising means for disposing a connector within said first cavity, said connector having an attachment portion and a head portion, said attachment portion protruding through said lid to engage an aperture in said top plate, said head portion encapsulated by said lid and said socket.

51. The apparatus of claim 49, wherein said biasing assembly includes disposing a biasing element between said socket and a bottom portion on said bottom plate.

52. The apparatus of claim 51, wherein said biasing element comprises at least one spiral spring.

53. The apparatus of claim 52, wherein said biasing element provides full compression at a range of between 100 to 300 pounds.

54. The apparatus of claim 52, wherein said biasing element is made of an elastomeric material.

55. The apparatus of claim 51, further including engaging said top portion and said bottom portion thereby forming a second cavity to encapsulate said bearing assembly and said biasing assembly.

56. The apparatus of claim 51, wherein said top portion has a first end and a second end, said first end having an inner edge defining a first aperture and said second end having an inner edge defining a second aperture, said bottom portion having a first end having an inner edge defining a third aperture, and said socket having a first outer edge and a second outer edge wherein said first outer edge is smaller in diameter than said second outer edge, wherein said first aperture is of a size allowing said first outer edge of said socket to extend through said first end while of a size precluding said second outer edge of said socket from extending through said first end, said second aperture is of a size allowing said second end of said socket to extend through said second aperture, and said third aperture is of a size sufficient to receive said biasing element.

57. The apparatus of claim 56, wherein said bottom portion of said biasing assembly further includes an outer edge of a size sufficient to fit within said second aperture of said top portion.

58. A shock-absorbing apparatus to couple a binding to a board, the apparatus comprising:

means for coupling a bottom plate to said board; and means for attaching a plurality of assemblies between said bottom plate and said binding to couple said bottom plate to said binding, wherein each of said plurality of assemblies further comprises a bearing assembly and a biasing assembly, said bearing assembly disposed coaxially with said biasing assembly, said biasing assembly oriented to press against said bottom plate, wherein said bearing assembly includes a top portion and a connecting assembly having a lid and a socket.

59. The apparatus of claim 58 further comprising means for engaging said lid and said socket thereby forming a first cavity in said connecting assembly.

60. The apparatus of claim 59 further comprising means for disposing a connector within said first cavity, said connector having an attachment portion and a head portion, said attachment portion protruding through said lid and engaging an aperture in said top plate, said head portion encapsulated by said lid and said socket.

61. The apparatus of claim 60, wherein said bearing assembly is responsive to mechanical energy encountered by the binding or board during use by engaging the binding to pivot from or move along an axis orthogonal to a top surface of the bottom plate.

62. The apparatus of claim 59, wherein said biasing assembly includes means for disposing a biasing element between said socket and a bottom portion on said bottom plate.

63. The apparatus of claim 62, wherein said biasing element comprises at least one spiral spring.

64. The apparatus of claim 62, wherein said biasing element provides full compression at a range of between 100 to 300 pounds.

65. The apparatus of claim 62, wherein said biasing element is made of an elastomeric material.

66. The apparatus of claim 62 further including means for engaging said top portion and said bottom portion thereby forming a second cavity to encapsulate said biasing assembly and said bearing assembly.

67. The apparatus of claim 62, wherein said top portion has a first end and a second end, said first end having an inner edge defining a first aperture and said second end having an inner edge defining a second aperture, said bottom portion having a first end having an inner edge defining a third aperture, and said socket having a first outer edge and a second outer edge wherein said first outer edge is smaller in diameter than said second outer edge, wherein said first aperture is of a size allowing said first outer edge of said socket to extend through said first end while of a size precluding said second outer edge of said socket from extending through said first end, said second aperture is of a size allowing said second end of said socket to extend through said second aperture, and said third aperture is of a size sufficient to receive said biasing element.

68. The apparatus of claim 62, wherein said bottom portion of said biasing assembly further includes an outer edge of a size sufficient to fit within said second aperture of said top portion.

* * * * *

UNITED STATES PATENT AND TRADEMARK OFFICE

CERTIFICATE OF CORRECTION

PATENT NO. : 6,655,700 B1 
DATED : December 2, 2003
INVENTOR(S) : Robert John Caputo and Michael Timothy Higgins It is certified that error appears in the above-identified patent and that said Letters Patent is hereby corrected as shown below:

Column 10,
Line 8, delete the first occurrence of -- with --.

Column 13,
Line 4, replace “aboard” with -- a board --.

Signed and Sealed this

Thirtieth Day of March, 2004

JON W. DUDAS
*Acting Director of the United States Patent and Trademark Office*